US005133389A

United States Patent [19]

Griffith

[11] Patent Number: 5,133,389

[45] Date of Patent: Jul. 28, 1992

[54] SOLENOID-CONTROLLED HEALD ROD SYSTEM

[75] Inventor: John D. Griffith, Sunderland, United Kingdom

[73] Assignee: Bonas Machine Company Limited, Gateshead, England

[21] Appl. No.: 689,843

[22] PCT Filed: Oct. 10, 1989

[86] PCT No.: PCT/GB89/01195

§ 371 Date: Jul. 8, 1991

§ 102(e) Date: Jul. 8, 1991

[87] PCT Pub. No.: WO90/05803

PCT Pub. Date: May 31, 1990

[30] Foreign Application Priority Data

Nov. 21, 1988 [GB] United Kingdom ..... 8827141

[51] Int. Cl.[5] ..... D03C 3/08; D03C 3/20

[52] U.S. Cl. ..... 139/455; 139/65

[58] Field of Search ..... 139/455, 59, 65

[56] References Cited

U.S. PATENT DOCUMENTS 4,022,251 5/1977 Bucher ..... 139/59
4,041,987 8/1977 Bucher ..... 139/59
4,936,357 6/1990 Keim et al. ..... 139/65 X

FOREIGN PATENT DOCUMENTS 0099254 1/1984 European Pat. Off. .
0119788 9/1984 European Pat. Off. .
0188074 7/1986 European Pat. Off. .
0287921 10/1988 European Pat. Off. .
2047755 12/1980 United Kingdom .

*Primary Examiner*—Andrew M. Falik
*Attorney, Agent, or Firm*—Dann, Dorfman, Herrell and Skillman

[57] ABSTRACT

A heald control system has a heald rod which is reciprocated along its longitudinal axis and has a resiliently deflectable body portion formed from a magnetically attractable material and a retention latch formation. During reciprocation, the heald rod is moved along a path of travel between first and second limits in a first zone where the body portion normally travels in a undeflected position and in a second zone where the body portion travels in a deflected position. A fixed cam is engageable with a cam on said body portion during the reciprocation to cause the body portion to move from the non-deflected to the deflected position during travel from the first zone into the second zone. A fixed latch is located to one side of the first zone of the path of travel to engage the latch formation only when the body portion is in said deflected position. An electromagnet is located adjacent said path of travel of the body portion when it is in its deflected position, so that the electromagnet when energized is capable of holding the body portion in the deflected position as the latch formation moves from the second zone and into registry with the fixed latch to cause the latch formation to engage the fixed latch.

13 Claims, 3 Drawing Sheets

SOLENOID-CONTROLLED HEALD ROD SYSTEM

Heald control devices for weaving machines, in which the movement of individual or groups of healds is controlled by an electrical signal are already known. One such heald control device is described in our UK Patent 2047755.

It is a general aim of the present invention to provide an improved heald control system which requires less electrical power to effect selection and can also be more compact.

According to the present invention there is provided a heald control system including a heald rod which is reciprocated along its longitudinal axis, the heald rod having a resiliently deflectable body portion formed from a magnetically attractable material, a retention latch formation mounted on the body portion, the retention latch formation during reciprocation of the heald rod being moved along a path of travel between first and second limits of reciprocal movement, said path of travel having a first zone movement wherein the body portion travels in an undeflected position and a second zone of movement wherein the body portion travels in a deflected position, fixed cam means engagable with cam means on said body portion during reciprocal movement of the heald rod to cause the body portion to move from the non-deflected to the deflected position, fixed latch means located to one side of the first zone of the path of travel and arranged to engage the latch formation on the body portion only when the body portion is in said deflected position, and an electromagnet located adjacent said path of travel, so that the body portion is located in the vicinity of the electromagnet when it is in its deflected position, the electromagnet when energised being capable of holding the body portion in the deflected position as the latch formation moves from the second zone and into the first zone of travel and thereby cause the latch formation to engage the fixed latch means.

Reference is now made to the accompanying drawings in which.

Figure 1:
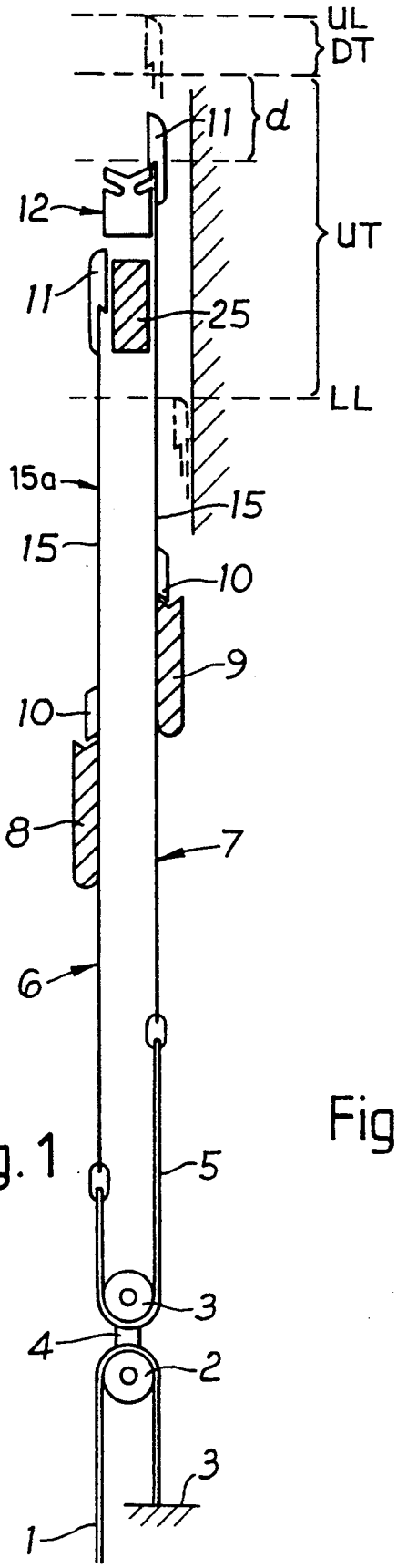
FIG. 1 illustrates the principle of operation of heald rod selection according to the present invention.

The method by which the healds are lifted is similar to that described in UK Patent No. 2047755. For example, as shown in FIG. 1, healds (not shown) are attached to a lifting cord 1 which passes over a pulley wheel 2 to a fixing on the jacquard frame 3. Pulley 2 is attached to a second pulley wheel 3 via a housing 4 such that both wheels can rotate but are in fixed relationship to each other.

A second cord 5 which passes round wheel 3 connects two heald rods 6 and 7. These heald rods are raised and lowered alternately by knives 8 and 9 which press against knife hooks or abutments 10.

The heald rods include a resiliently deflectable body portion 15*a* formed from a magnetically attractable material on which is mounted latches, preferably in the form of hooks 11 which the heald control device causes to be either held or not by a fixed latch stop 12.

The sequence of operation of the hooks is described in Patent Nos. UK 2047755 and European 84301486.1 as are the knife drive means and the method of mounting and arranging the heald control devices.

The general principle of the operation will now be described with reference to FIG. 1.

The latches 11 are each reciprocated along a path of travel between a first or lower limit LL and a second or upper limit UL. This path of travel has a first zone UT wherein the latch travels with the body portion 15*a* in an undeflected state and a second zone DT wherein the latch travels with the body portion 15*a* in a deflected state.

Accordingly during each reciprocation of a heald rod, the latch travels from the lower limit LL along the first zone toward the upper limit UL and the body portion 15*a* remains in an undeflected state until the latch enters the second zone DT. When the latch reaches the upper limit UL the body portion 15*a* has been displaced as hereafter described, and is in a fully deflected state and is located in the vicinity of the electromagnet 25, i.e.the body portion contacts or is closely spaced from the pole(s) of the electromagnet 25.

On return of the latch from the upper limit UL towards the lower limit the body portion returns to its undeflected state as the latch exits the second zone and enters the first zone.

The fixed latch 12 is located in the first zone and so in the absence of energization of the electromagnet the latch passes by the fixed latch 12 without engagement. The latch 12 is located by a distance d from the exit of the second zone which is sufficient to enable the body portion to return to its undeflected state before latch 11 encounters the fixed latch 12.

If the electromagnet 25 is energised prior to the latch 11 leaving the second zone DT, the electromagnet 25 magnetically attracts the body portion 15*a* and holds it in its deflected state while the latch 11 travels across distance d. Accordingly, the latch 11 engages latch 12 and arrests further movement of the latch 11 toward the lower limit LL.

Figure 2:
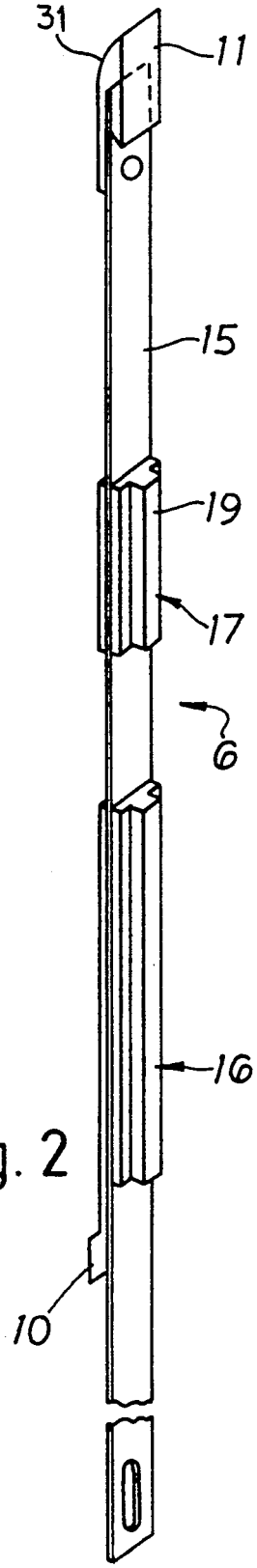
FIG. 2 shows a heald rod according to a first embodiment of the present invention in detail.

Specific examples of the present invention based upon the above principle are described below. In FIG. 2 the heald rods 6, 7 comprise a magnetic resilient strip 15 typically made from spring steel with abutment 10 and also latch 11 being formed from plastics mouldings which are moulded onto the strip. Guide blocks 16 and 17 are also preferably formed from plastics mouldings and cooperate with the body 21 and intermediate channel or guide members 20 of the heald control devices to guide reciprocal movement of the heald rod.

A lower portion 21*a* of the body 21 is provided with grooves on opposite sides and the facing sides of the heald rods 6 and 7 are provided with projecting tongues 19 which are slidingly received in the grooves in body 21. An intermediate portion 21*b* located above the lower portion 21*a* is recessed so that block 17 only slides into the lower portion 21*a* when the heald rod is lowered. When the heald rod is raised, the block 17 enters the recess 21*c* and allows deflection of the heald rod to occur at a location intermediate blocks 16 and 17.

Figure 4:
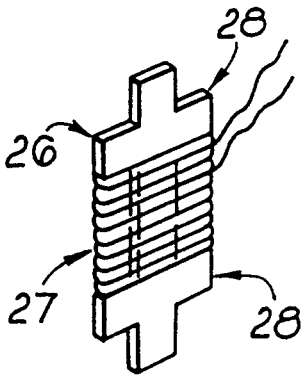
FIG. 4 shows the construction of an electromagnet for use in the heald control device of the present invention.
Figure 3:
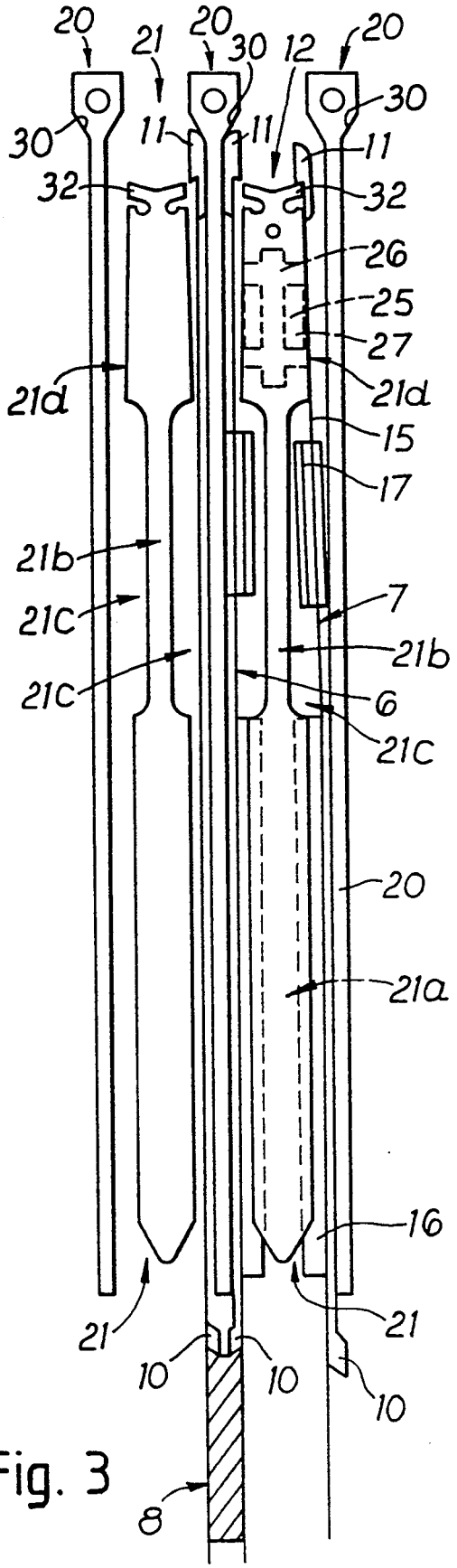
FIG. 3 is an elevation view of an assembly of heald control devices according to a first embodiment of the present invention.

The electromagnet 25 is encapsulated into the upper portion 21*d* of body 21 either during a moulding process which forms the body, or by making the body 21 in two parts which trap the electromagnet on assembly. The electromagnet (FIG. 4) consists of a soft iron or steel core 26 and electrical wire winding 27. When a current is passed through the winding, lugs 28 at each end become the north and south poles of a magnet. The faces of these lugs are flush with the side surfaces of body 21.

The latches 11 are provided with cam means in the form of a deflection surface 31 which co-operate with fixed cam means in the form of a deflection surface or abutment 30. The abutment 30 forms a transition between the first zone and the second zone.

Figure 5:
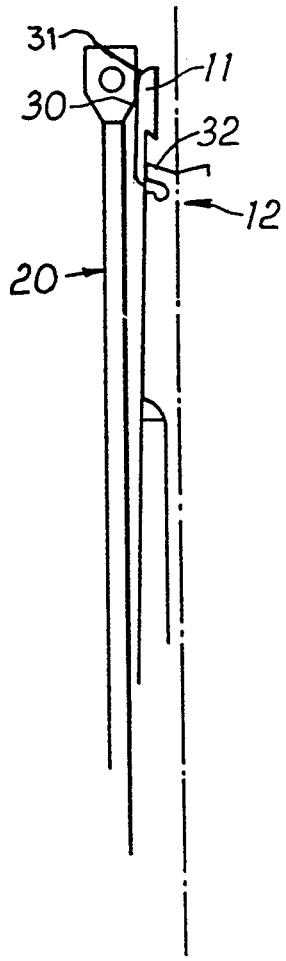
FIG. 5 illustrates the operation of the top of a heald rod at the top of its travel.

When a heald rod 6 or 7 is raised towards its upper position the abutment 30 on guide 20 (FIG. 5) is engaged by the upper surface 31 of the latch 11 and causes the body portion 15*a* to be deflected towards the electromagnet. As indicated above bending of the hook occurs at a location intermediate the blocks 16 and 17 which is relatively a large distance from latch 11 and thereby resistance to bending is relatively small and can thereby be achieved relatively quickly. The arrangement of abutment 30 and latch 11 is such that the amount of deflection caused moves the heald rod body portion 15*a* into engagement with the electromagnet. If the magnet is energized the body portion 15*a* will be held against it and thus remain deflected, so that the heald rod begins to slide down, the latch 11 will be held by latch stop 32 so as to keep the heald in the raised position shown in full lines in FIG. 1. The latch stop preferably forms part of body 21. The stop 32 may be defined by a tongue as illustrated to allow it to give slightly to reduce the impact between the latch and stop.

When the magnet is not energised the heald rod springs back to a vertical position on being lowered and slides past the stop 32 to the lower position shown in broken lines in FIG. 1.

It may be necessary to fit a small reverse current into the electromagnet when it is switched off to eliminate any resistive magnetism.

It can be seen that this invention allows for a small electromagnet of low power consumption as it has only to hold on the heald rod rather than actually deflect it. The heald rod body portion 15*a* can also be constructed relatively narrow to thereby reduce weight and resistance to bending, as the latch 11 can extend across its entire width.

A second embodiment is illustrated in FIGS. 6 to 9. The second embodiment operates in a similar manner to the embodiment described with reference to FIGS. 1 to 5 and accordingly includes the same basic components; these are indicated by the same reference numerals.

In the second embodiment, the heald rods 6 have an elongate body 50 formed from a plastics material. The upper end portion 51 of the heald rod is formed by a resilient magnetic metal strip which at one end is embedded in the one end of the elongate body 50 and which at its opposite end carries a latch 11 which is also preferably formed from a plastics material. Accordingly each heald rod 6 is conveniently formed by injection moulding. The knife hook 10 is formed integrally with the body 50.

Figure 6:
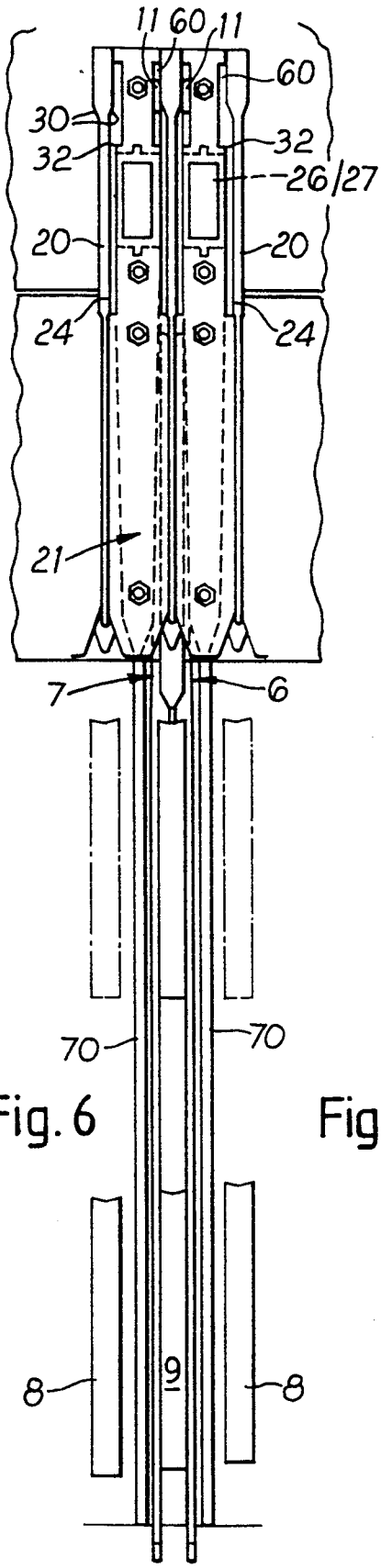
FIG. 6 is an elevation view similar to FIG. 3 showing heald control devices according to a second embodiment of the present invention.

As seen in FIG. 6 the knives 8 and 9 oscillate between a lowermost position (shown in solid lines) and an uppermost position (shown in phantom lines). The distance between latch 11 and the knife hook 10 is chosen so as to be greater than the distance between the lower end of the heald devices and the upper edge of knives 8 and 9 when at their lowermost position. In this way when the latch 11 is located at its lowermost position it remains captive between the body 21 of a heald device and the adjacent guide member 20, ie throughout its entire path of travel it is located within the guide channel defined between a heald device and the adjacent guide member 20.

The distance between the knife hook 10 and the latch 11 is chosen such that when the knives 8 and 9 are in their uppermost position the latch 11 is located at its uppermost position in the recess 60 defined above the latch stop 32. When the latch 11 engages the abutment 30 bending of the metal strip occurs primarily at the juncture between the metal strip and the upper end of body 50. The length of the metal strip is therefore chosen to provide a desired low resistance to bending and in addition the thickness and width of the metal strip are also chosen to provide the desired low resistance to bending. In this way the electromagnet can be of low power consumption.

In the embodiment illustrated in FIGS. 6 to 9 the metal strip has a thickness of about 0.35 mm and a width of 4 mm.

Although the thin metal strip is arranged so as to provide little resistance to bending it is also arranged to have sufficient resilience to bias the latch 11 into contact with the sidewall 24 of the guide 20 during reciprocation of the latch 11 between its upper and lowermost positions and in particular on emergence of latch 11 from the recess 60 when the electromagnet has not been energized. This ensures that incorrect selection does not occur.

Preferably the cross-section of the guide channel defined between bodies 21 and adjacent guide members 21' is chosen to have a size and shape which is substantially the same as the cross-section of the latch 11. In this way the latch 11 is positively guided throughout the majority of its path of travel.

Preferably guide plates 70 are provided located between adjacent knives 8 and 9. The body 50 of each heald rod is thereby located between a knife 8, 9 and a guide plate 70 such that it is guided and supported against deflection during its reciprocatory motion.

Figure 7:
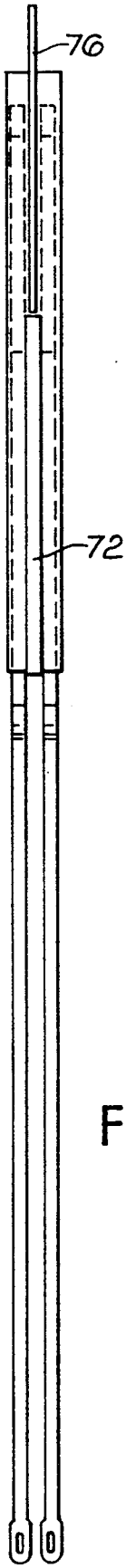
FIG. 7 is a side view of the embodiment shown in FIG. 6.
Figure 8:
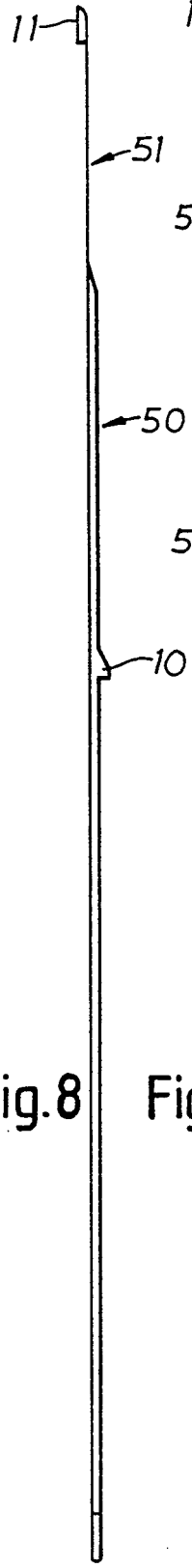
FIG. 8 is an elevational view of a heald rod as used in the embodiment illustrated in FIG. 6.
Figure 9:
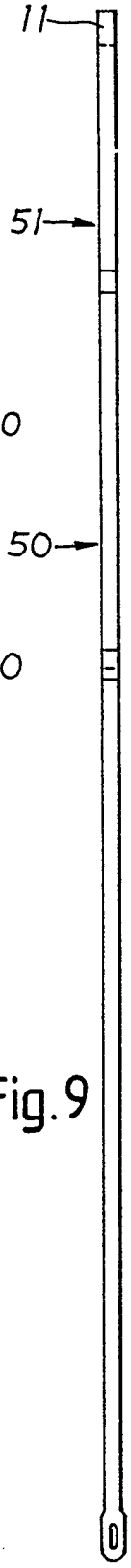
FIG. 9 is a side view of the heald rod shown in FIG. 8.

As seen in FIG. 7 a row of heald devices and interposed guides 20 are located on opposite sides of metal support plate 72 which is secured to the frame of the loom. Located above the plate 72 and interposed between the rows of heald devices is a printed circuit board 76 which possesses the electrical circuitry for controlling the electromagnets.

I claim:

1. A heald control system including a heald rod which is reciprocated along its longitudinal axis, the heald rod having a resiliently deflectable body portion formed from a magnetically attractable material, a retention latch formation mounted on the body portion, the retention latch formation during reciprocation of the heald rod being moved along a path of travel between first and second limits of reciprocal movement, said path of travel having a first zone of movement wherein the body portion travels in an undeflected position and a second zone of movement wherein the body portion travels in a deflected position, fixed cam means engagable with said body portion during reciprocal movement of the heald rod to cause the body portion to move from the non-deflected to the deflected position, fixed latch means located to one side of the first zone of the path of travel and arranged to engage the latch formation on the body portion only when the body portion is in said deflected position, and an electromagnet located adjacent said path of travel so that the body portion is located in the vicinity of the electromagnet when it is in its deflected position, the electromagnet being positioned and arranged so that when energized it holds the body portion in the deflected position as the latch formation moves from the second zone and into the first zone of travel and thereby causes the latch formation to engage the fixed latch means.

2. A system according to claim 1, wherein the body portion is formed from a strip of resilient metal.

3. A system according to claim 2, wherein the retention latch is defined by a hook projecting laterally from the body portion.

4. A system according to claim 3, wherein the hook comprises a plastics moulding mounted on the body portion.

5. A system according to claim 3, wherein the hook extends across the entire width of the strip.

6. A system according to claim 1, wherein said body portion has cam means to engage said fixed cam means and comprising a deflection surface formed on said latch formation.

7. A system according to claim 1, wherein the latch formation is guided during reciprocation along said path of travel within a guide channel, the guide channel having a first portion corresponding to said first zone of travel and a second portion corresponding to said second zone of travel, a transition wall being provided in the channel between said first and second portions to define said fixed cam means.

8. A system according to claim 7, wherein the guide channel is defined on one side by a retention body housing said electromagnet and on the opposite side by a channel member including said transition wall.

9. A system according to claim 8 wherein the guide channel has cross-section shape and dimensions substantially the same as the cross-section of the latch formation such that the latch formation is positively guided.

10. A system according to claim 8 wherein the fixed latch means is mounted on the retention body.

11. A system according to claim 10, wherein the fixed latch means is defined by a shoulder on said retention body.

12. A system according to claim 10, wherein the fixed latch means is defined by a resilient tongue.

13. A system according to claim 7 wherein the guide channel has cross-section shape and dimensions substantially the same as the cross-section of the latch formation such that the latch formation is positively guided.

* * * * *